United States Patent [19]

Ott

[11] Patent Number: 4,486,737

[45] Date of Patent: Dec. 4, 1984

[54] ELECTRIC RESISTOR WHICH HAS LOW RESISTANCE AND SERVES PARTICULARLY FOR PROTECTING AN ELECTRIC CONSUMER AGAINST ELECTRIC OVERLOAD, AND METHOD FOR THE MANUFACTURE THEREOF

[75] Inventor: Günter Ott, Schwanberg, Austria

[73] Assignee: Siemens Aktiengesellschaft, Berlin and Munich, Fed. Rep. of Germany

[21] Appl. No.: 463,912

[22] Filed: Feb. 4, 1983

[30] Foreign Application Priority Data

Feb. 8, 1982 [DE] Fed. Rep. of Germany ..... 3204207

[51] Int. Cl.[3] ..... H01C 1/14; H01C 7/02

[52] U.S. Cl. ..... 338/22 R; 338/20; 338/22 SD; 338/309; 219/505; 361/24

[58] Field of Search ..... 338/21, 20, 22 R, 22 SD, 338/309; 219/505, 504; 361/24, 27, 29

[56] References Cited

U.S. PATENT DOCUMENTS

| | | | |
|---|---|---|---|
| 4,107,515 | 8/1978 | Kulwicki | 338/22 R X |
| 4,162,395 | 7/1979 | Kobayashi et al. | 219/504 X |
| 4,180,901 | 1/1980 | Kulwicki | 338/22 SD |
| 4,189,700 | 2/1980 | Hill | 338/22 SD X |
| 4,198,669 | 4/1980 | Kulwicki | 361/24 |
| 4,264,888 | 4/1981 | Berg | 338/25 |
| 4,363,958 | 12/1982 | Kobayashi et al. | 219/505 |

OTHER PUBLICATIONS

E. Audvich, "PTC Thermistors as Self Regulating Heating Elements", Phillips Technical Review, vol. 30, pp. 170–177, Dec. 1969.

*Primary Examiner*—C. L. Albritton
*Assistant Examiner*—C. N. Sears
*Attorney, Agent, or Firm*—Herbert L. Lerner; Laurence A. Greenberg

[57] ABSTRACT

Electric resistor, including a PTC body being formed of ceramic material and having opposite poles, two opposite outer side surfaces being parallel to the longitudinal axis of the PTC body and two opposite end faces perpendicular to the outer side surfaces, the PTC body having rows of mutually parallel depressions formed in the end faces defining inner surfaces and leaving partitions therebetween, metal coatings disposed on the inner surfaces at the opposite poles and partitions, metal layers disposed on the outer side surfaces, and metal strips being disposed on the end faces interleaved in comb-fashion and being connected to the metal layers, defining current flow paths from the metal layers and metal strips through the partitions being perpendicular to the longitudinal axes of the depressions and electrically connecting the pole coatings of a respective row of depressions to each other, and a method for the manufacture thereof.

10 Claims, 3 Drawing Figures

ELECTRIC RESISTOR WHICH HAS LOW RESISTANCE AND SERVES PARTICULARLY FOR PROTECTING AN ELECTRIC CONSUMER AGAINST ELECTRIC OVERLOAD, AND METHOD FOR THE MANUFACTURE THEREOF

The invention relates to an electric resistor which has low resistance (less than 50 mohm), which serves particularly for protecting an electric consumer against electric overload and which is formed of a PTC (positive temperature coefficient) body formed of ceramic material that is traversed by mutually parallel depressions, the inner surfaces of which are provided on opposite poles with metal coatings, so that the current flows through partitions perpendicularly to the longitudinal axes of the depressions, and coatings at opposite poles are connected to each other on end faces of the PTC body, for the current supply.

The invention further relates to a method for manufacturing such an electric resistor.

In German Published, Prosecuted Application DE-AS No. 24 10 999 corresponding to U.S. Pat. No. 3,927,300, a ceramic PTC resistor which is constructed as a heating element in honeycomb form, is described. The inner surfaces of the individual honeycomb canals are not metallized but rather only opposite end faces of the honeycomb body are metallized, so that in this ceramic PTC resistor, the current passes from end face to end face through the entire body. It is especially important to note that electric low-resistance resistors with such PTC bodies (PTC is the abbreviation for electric resistors with a positive temperature coefficient and is primarily used in the technical literature for ceramic PTC resistors based on ceramic material which has a perovskite structure and is made into a semconductor by doping) cannot be obtained in this manner since for such a case, the thickness of the bodies, as measured from end face to end face, would have to be very small. The known PTC resistors having a body with a honeycomb structure are used, for instance, as heating elements for the continuous-flow heating of flowing media.

In German Published, Non-Prosecuted Application DE-OS No. 30 16 725 corresponding to U.S. Pat. No. 4,264,888, among other things, a method for manufacturing PTC bodies which are constructed as indicated above, is described. The inner surfaces of the individual depressions formed as canals are metallized in such a manner that the current passes through the thin walls between the individual canals. While low-resistance PTC conductors can be made in this manner, if material suitably selected with respect to the Curie temperature and resistivity is used therefore, metallizing these PTC bodies presents technical difficulties regarding the process. Thus, depressions and cross connections disposed at different heights must be provided in the end faces in which the canal-shaped depressions end, so that it is ensured that finally, in the finished electric resistor, the individual depressions are contacted alternatingly.

For the manufacture of low-resistance electric resistors with PTC bodies, ceramic PTC conductor materials which have an electric resistivity of up from 5 ohm.cm are already available. To manufacture resistors with particularly low electric resistance (less than 50 mohm) therefrom, particularly large cross-sectional areas are required. It has therefore already been attempted to make such electric resistors therefrom with PTC bodies which are particularly thin but have a very large area. With plate or disc-like constructions, this leads to components with very large surfaces, which in addition, can stand practically no mechanical load.

It is accordingly an object of the invention to provide an electric resistor which has low resistance and serves particularly for protecting an electric consumer against electric overload, which overcomes the hereinaforementioned disadvantages of the heretofore-known devices of this general type, and which exhibits the highest possible mechanical strength and is particularly simple with respect to the manufacture of the PTC body as well as with respect to the metallization; it is a further object of the invention to describe a method for manufacturing such an electric resistor with a PTC body.

With the foregoing and other objects in view there is provided, in accordance with the invention, an electric resistor which has a low resistance ($\leqq$50 m ohm), especially serving for the protection of an electric consumer against electric overload, comprising a PTC body being formed of ceramic material and having opposite poles, two opposite outer side surfaces being parallel to the longitudinal axis of the PTC body and two opposite end faces perpendicular to the outer side surfaces, the PTC body having rows of mutually parallel depressions formed in the end faces defining inner surfaces and leaving partitions therebetween, metal coatings disposed on the inner surfaces at the opposite poles and partitions, metal layers disposed on the outer side surfaces, and metal strips being disposed on the end faces interleaved in comb-fashion and being connected to the metal layers, defining current flow paths from the metal layers and metal strips through the partitions being perpendicular to the longitudinal axes of the depressions and electrically connecting the pole coatings of a respective row of depressions to each other.

In accordance with another feature of the invention, the depressions are open at both of the end faces.

In accordance with a further feature of the invention, there is provided an electric resistor, comprising a PTC body being formed of ceramic material and having opposite poles and first and second opposite end faces, the PTC body having mutually parallel blind depressions formed in the first and second end faces interleaved in chess board-fashion defining inner surfaces and leaving partitions therebetween, and metal coatings disposed on the inner surfaces at the opposite poles, defining current flow paths through the partitions being perpendicular to the longitudinal axes of the depressions and connecting the pole coatings on the opposite end faces to each other for supplying current.

In accordance with an added feature of the invention, the depressions formed in the first end face do not extend to the second end face, and the depressions formed in the second end face do not extend to the first end face.

In accordance with an additional feature of the invention, the PTC body is formed of ceramic perovskite material made semi-conducting by doping on the basis of $BaTiO_3$, with a Curie temperature being at least equal to 120° C. and an electric resistivity of between 5 and 30 ohm.cm at 25° C.

In accordance with again another feature of the invention, the PTC body is formed of ceramic perovskite material made semi-conducting by doping on the basis of $(Ba_{4-x}Pb_x)TiO_3$, wherein $x>0$ up to 0.5, with a Curie temperature at least equal to 120° C. and an electric resistivity of between 5 and 30 ohm.cm at 25° C.

In accordance with again a further feature of the invention, there is also provided a method for the manufacture of an electric resistor, which comprises molding a PTC body from ceramic raw material forming a pair of opposite end faces, two pairs of opposite outer side surfaces and rows of depressions in the end faces defining inner surfaces, subsequently subjecting the body to a ceramic sintering process, cooling the body, metallizing the entire surface of the body including the end faces, the outer side surface and the inner surfaces of the depressions in one operation after cooling, and subsequently demetallizing one pair of the outer side surfaces and intermediate surface portions of the end faces leaving metal strips on the end faces, to form insulating surfaces.

In accordance with another mode of the invention, there is provided a method which comprises forming raised portions between the rows of depressions during molding, and at least partly removing the raised portions by grinding after metallization, for demetallizing the intermediate portions between the metal strips.

The advantages of the invention stem from the fact that, because the size of the PTC bodies can practically be chosen at will, particularly low-resistance electric resistors are obtained which can preferably be employed for the protection of an electric consumer against overload. In the event of an overload, the otherwise low-resistance electric resistor assumes a very high resistance in accordance with the typical PTC characteristic (sudden increase of the resistance value by three or more powers of ten in the range of the Curie temperature) and thereby acts as protection for the electric consumer.

If, according to the first alternative of the invention, the depressions are represented by canals which go through from one end face to the other, it is, of course, also possible to use the PTC body for heating media which flow thorugh it.

The more depressions there are in the PTC body, the lower the resistance of the electric resistor becomes.

The inner width of the depressions depends on the metallizing process. If the metallization is prepared, for instance, by a flame-spraying method, as is known in a different context, it is necessary to make the inner width larger, about 2 to 5 mm. In the case of metallizing processes, in which the PTC-body is metallized chemically, inner widths of the depressions of 1 mm and possibly even less, are possible.

With a wall thickness of 0.6 mm between the individual opposite-pole canals, about 50 mohm is achieved for 1 $cm^3$ of volume of the PTC body if a material with 5 ohm.cm is used, so that such an electric resistor is suitable for use up to 20 V and can stand a current of 6 to 10 A.

It is also noteworthy here that with an increase of the number of depressions, an electric resistor with that much less resistance can be obtained.

If a PTC material with 30 ohm.cm electric resistivity and a wall thickness of 2 mm between the depressions is used, it becomes possible to use it at 220 to 250 V and 3 to 5 A, with a large volume of the PTC body.

The manufacture of an electric resistor according to the invention is particularly simple and is implemented by a molding process, in which a monolithic body with depressions is generated; fine-particle ceramic raw material is used for this molding process. The molded PTC body is thereupon ceramically sintered in a manner known per se, using the customary temperatures (1150° to 1350° C.). After the sintering, the entire surface is provided with a metal layer, whereupon the outer side surfaces of the PTC body which are parallel to the depressions are freed of the metal layers for forming the individual opposite-pole electrodes which are separated from each other. Metallizing processes may, for instance, be chemical nickel-plating or flame spraying; both are sufficiently well known.

If the depressions are formed as continuous canals, increased heat transfer due to convection takes place at the inner walls of the holes, whereby the transition-point current is increased over that of an embodiment with non-continuous depressions for the same electric resistance.

Other features which are considered as characteristic for the invention are set forth in the appended claims.

Although the invention is illustrated and described herein as embodied in an electric resistor which has low resistance and serves particularly for protecting an electric consumer against electric overload, and method for the manufacture thereof, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
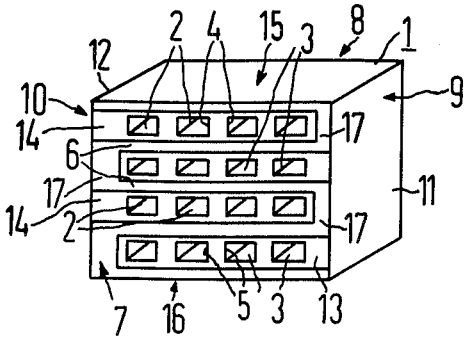
FIG. 1 is a diagrammatic perspective view of an embodiment of the invention with depressions provided in the form of continuous canals.

Referring now to the figures of the drawing and first particularly to FIG. 1 thereof, there is seen a PTC body 1 having depressions 2 and 3 formed therein in rows, which extend from one end face 7 to another end face 8 and are thus canal-shaped. The depressions 2 and 3 are provided on their entire inner surfaces with metallizations 4 and 5. Metallizations 11 and 12 are applied to outer surfaces 9 and 10. Metal strips 13 and 14 start from the outer surfaces 9 and 10 and run on the two end faces 7 and 8 which are perpendicular to the outer surfaces 9 and 10. These metal strips 13 and 14 are connected to the metal layers 11 and 12 on the outer surfaces 9 and 10, in such a manner that they are interleaved in comb-fashion and are connected to each other in an electrically conducting manner with the metal coatings 4 and 5 of the partitions of a respective row of depressions 2 and 3. In this manner, a current flows through partitions 6 perpendicularly to the longitudinal axes of the canal-like depressions 2 and 3 if a voltage is applied to the metal layers 11 and 12.

The PTC body 1 is advantageously made in such a manner that the body and the canal-shaped depressions 2 and 3 are formed by a molding operation. The body, which is formed of ceramic raw material after this molding operation, is then subjected to a sintering process and is then metallized on all parts of the surface, i.e., on the end faces 7 and 8, the outer surfaces 9 and 10, the other two outer surfaces 15 and 16, and the inside surfaces of the depressions 2 and 3. The outer surfaces 15 and 16 are then freed of the metallization to generate insulating areas between the metal layers 11 and 12. This demetallization of the outer surfaces 15 and 16 can be done by grinding, but it is also possible to cover up these surfaces prior to the metallization so that no metal layer is formed there. A meander-shaped intermediate surface 17 between the metal strips 13 and 14 is likewise produced by grinding. It is particularly advantageous to generate raised, i.e., projecting parts between the respective rows of depressions 2 and 3 for demetallizing this intermediate area 17 in the molding process of the PTC body; these parts are then removed after the entire body is metallized, at least in part by grinding, so that the insulating intermediate area 17 is produced.

Figure 2:
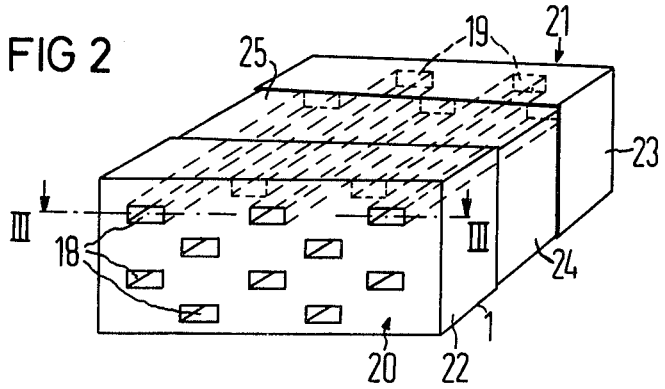
FIG. 2 is a perspective view of another embodiment provided with non-continuous depressions.

FIG. 2 is a perspective view of another embodiment of the PTC body 1, in which depressions 18 are open at an end face 20, but are not completely open continuously through to another end face 21. On the other hand, depressions 19 are open at the end face 21 and do not extend completely to the end face 20. The depressions 18 and 19 are formed in the PTC body 1 in such a way that they are, so to speak, either alternatingly open at one end face in chess-board fashion and closed at the other one or they are otherwise open at the other end face and closed at the first one.

This body can likewise and advantageously be manufactured in a single molding operation and is completely metallized after sintering. By removing the metal layer at the outer surface adjoining the end faces 20 and 21, insulating areas 24 and 25 are produced, and together with the corresponding free parts result in an insulation path between metal layers 22 and 23 at the respective opposite outer surfaces.

Figure 3:
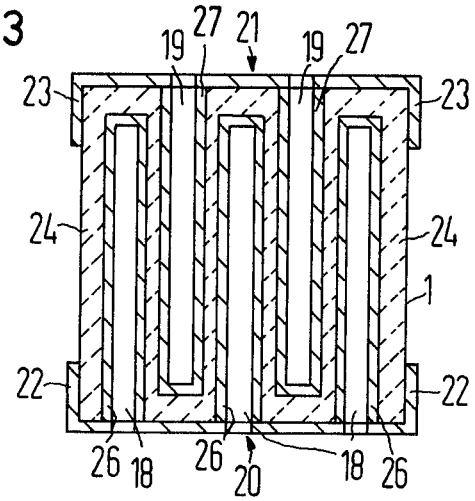
FIG. 3 is a cross-sectional view taken along the line III—III in FIG. 2, in the direction of the arrows.

FIG. 3 shows a cross section alone the line III—III in FIG. 2, which illustrates that the canals 18 are open at the end face 20 and are closed in vicinity of the end face 21, while the canals 19 are open at the end face 21 and are closed in vicinity of the end face 20. From the metal layers 22 and 23, metallizations 26 extend into the depressions 18, and metallizations 27 extend into the depressions 19. These metallizations represent, so to speak, the opposite-pole coatings, so that if voltage is applied, the current passes through the very thin partitions between the canals 18 and 19 perpendicularly to the longitudinal axes of these canals.

The foregoing is a description corresponding to German Application No. P 32 04 207.8, dated Feb. 8, 1982, the International priority of which is being claimed for the instant application, and which is hereby made part of this application. Any discrepancies between the foregoing specification and the aforementioned corresponding German application are to be resolved in favor of the latter.

I claim:

1. Electric resistor, comprising a PTC body being formed of ceramic material and having opposite poles, two opposite outer side surfaces being parallel to the longitudinal axis of said PTC body and two opposite end faces perpendicular to said outer side surfaces, said PTC body having rows of mutually parallel depressions formed in said end faces defining inner surfaces and leaving partitions therebetween, metal coatings disposed on said inner surfaces at said opposite poles and partitions, metal layers disposed on said outer side surfaces, and metal strips being disposed on said end faces interleaved in comb-fashion and being connected to said metal coatings and to said metal layers, defining current flow paths from said metal layers and metal strips through said partitions being perpendicular to the longitudinal axes of said depressions and electrically connecting said pole coatings of a respective row of depressions to each other.

2. Electric resistor according to claim 1, wherein said depressions are open at both of said end faces.

3. Electric resistor according to claim 1, wherein said PTC body is formed of ceramic perovskite material made semi-conducting by doping on the basis of $BaTiO_3$, with a Curie temperature being at least equal to 120° C. and an electric resistivity of between 5 and 30 ohm.cm at 25° C.

4. Electric resistor according to claim 2, wherein said PTC body is formed of ceramic perovskite material made semi-conducting by doping on the basis of $BaTiO_3$, with a Curie temperature being at least equal to 120° C. and an electric resistivity of between 5 and 30 ohm.cm at 25° C.

5. Electric resistor according to claim 1, wherein said PTC body is formed of ceramic perovskite material made semi-conducting by doping on the basis of $(Ba_{1-x}Pb_x)TiO_3$, wherein $x>0$ up to 0.5, with a Curie temperature at least equal to 120° C. and an electric resistivity of between 5 and 30 ohm.cm at 25° C.

6. Electric resistor according to claim 2, wherein said PTC body is formed of ceramic perovskite material made semi-conducting by doping on the basis of $(Ba_{1-x}Pb_x)TiO_3$, wherein $x>0$ up to 0.5, with a Curie temperature at least equal to 120° C. and an electric resistivity of between 5 and 30 ohm.cm at 25° C.

7. Electric resistor, comprising a PTC body being formed of ceramic material and having opposite poles and first and second opposite end faces, said PTC body having mutually parallel blind depressions formed in said first and second end faces interleaved in chessboard fashion defining inner surfaces and leaving partitions therebetween, and metal coatings disposed on said inner surfaces at said opposite poles, defining current flow paths through said partitions being perpendicular to the longitudinal axes of said depressions and connecting said pole coatings on said opposite end faces to each other for supplying current.

8. Electric resistor according to claim 7, wherein said depressions formed in said first end face do not extend to said second end face, and said depressions formed in said second end face do not extend to said first end face.

9. Electric resistor according to claim 7, wherein said PTC body is formed of ceramic perovskite material made semi-conducting by doping on the basis of $BaTiO_3$, with a Curie temperature being at least equal to 120° C. and an electric resistivity of between 5 and 30 ohm.cm at 25° C.

10. Electric resistor according to claim 7, wherein said PTC body is formed of ceramic perovskite material made semi-conducting by doping on the basis of $(Ba_{1-x}Pb_x)TiO_3$, wherein $x>0$ up to 0.5, resistivity of between 5 and 30 ohm.cm at 25° C.

* * * * *